US005479904A

United States Patent [19]

Fujimori et al.

[11] Patent Number: 5,479,904

[45] Date of Patent: Jan. 2, 1996

[54] FUEL VAPOR COLLECTING SYSTEM FOR AN INTERNAL COMBUSTION ENGINE

[75] Inventors: Yoshitomo Fujimori; Hiroaki Mihara, both of Saitama, Japan

[73] Assignee: Honda Giken Kogyo Kabushiki Kaisha, Tokyo, Japan

[21] Appl. No.: 350,178

[22] Filed: Nov. 30, 1994

[30] Foreign Application Priority Data

Dec. 16, 1993 [JP] Japan ..... 5-342717

[51] Int. Cl.[6] ..... F02M 37/04

[52] U.S. Cl. ..... 123/520; 123/179.16

[58] Field of Search ..... 123/520, 519, 123/518, 516, 521, 198 D, 179.17, 179.16

[56] References Cited

U.S. PATENT DOCUMENTS

| | | | |
|---|---|---|---|
| 3,515,107 | 6/1970 | Joyce | 123/520 |
| 3,575,152 | 9/1971 | Wentworth | 123/520 |
| 4,811,718 | 3/1989 | Sonoda | 123/179.16 |
| 4,867,126 | 9/1989 | Yonekawa | 123/179.16 |
| 4,951,643 | 8/1990 | Sato | 123/520 |
| 5,224,456 | 7/1993 | Hosoda | 123/174.16 |
| 5,398,660 | 3/1995 | Koyama | 123/520 |

FOREIGN PATENT DOCUMENTS

| | | | |
|---|---|---|---|
| 0023348 | 2/1980 | Japan | 123/520 |
| 0117155 | 5/1988 | Japan | 123/519 |
| 0176650 | 7/1988 | Japan | 123/519 |

*Primary Examiner*—Carl S. Miller

*Attorney, Agent, or Firm*—Nikaido, Marmelstein, Murray & Oram

[57] ABSTRACT

Plural canisters adsorb fuel vapor generating from a fuel tank (and a float chamber) while an engine stops. Purge means purge fuel vapor adsorbed in one or more canisters selected to be purged when the engine has been started. Unselected canister(s) is additionally selected as an object(s) for purging as the time elapses after the starting of the engine. At the initial purging stage, only fuel vapor adsorbed in the selected canister(s) is purged and gradually supplied to an inspire system, so as to prevent the air-fuel ratio from being over-rich especially at the start of the engine. Other canister(s) is subjected to purging thereafter, and eventually the fuel vapors adsorbed in all canisters are purged at the same time. Purging canister(s) is done in a short time and is made rather even.

11 Claims, 5 Drawing Sheets

FUEL VAPOR COLLECTING SYSTEM FOR AN INTERNAL COMBUSTION ENGINE

BACKGROUND OF THE INVENTION

1. Field of the Invention

The present invention is related to a fuel vapor collecting system wherein, in an automobile or the like, a fuel vapor generating from a fuel tank or the like during a stopping of an engine, namely, the vapor of a HC (hydrocarbon) is collected by an adsorbent, purged from the adsorbent using a negative intake pressure when the engine is in operation, and sucked into an intake system.

2. Description of the Prior Art

FIG. 6 is a system diagram of the conventional fuel vapor collecting system described in the Japanese Patent Application Laid-open No. 63-117155 official gazette. A canister 14 contains an adsorbent 16 for high-boiling point HC which mainly adsorbs high-boiling point HC in a fuel vapor, and a canister 15 contains an adsorbent 17 for low-boiling point HC which mainly adsorbs low-boiling point HC. The fuel vapor is introduced into the canister 14 from the upper space of a fuel tank 11 via a fuel vapor passage 18, and the fuel vapor is also introduced from a float chamber 12 via a fuel vapor passage 19. An electromagnetic valve $VL_1$ is provided in the passage 19.

The canisters 14 and 15 are connected in series by a fuel vapor passage 21, so that the fuel vapor having passed through the adsorbent 16 in the canister 14 is sent to the adsorbent 17 in the canister 15. An electromagnetic valve $VL_2$ is provided in the passage 21. Fuel vapor purging passages 26 and 27 respectively connected to the canisters 14 and 15 are connected to the stopping of the intake manifold (inspire system) 13, after being joined with a common fuel vapor purging passage 28. To the side of each canister 14, 15 opposite to the side thereof to which the purging passages 26 and 27 are connected, passages 23 and 24 for introducing the air (atmosphere) for purging are connected, respectively. An electromagnetic valve $VL_5$ is provided in the passage 23.

In the purging passage 28, an electromagnetic valve $VL_4$ (three-way valve) is provided at the point where the purging passages 26 and 27 meet each other, and an electromagnetic valve $VL_3$ is provided in the purging passage 26 before it meets with the passage 27. The arrows of dashed line in the figure represent the flows of the fuel vapor when it is purged, and solid lines represent the vapor flows when it is adsorbed.

In the fuel vapor collecting system shown in FIG. 6, while the engine stops, the fuel vapor is introduced into the canister 14 and then further introduced via the passage 21 into the canister 15 where it is adsorbed. After the engine has started, the canisters 14 and 15 to be purged are alternately switched by switching the electromagnetic valves $VL_5$, $VL_4$ and $VL_3$, whereby both of the high- and low-boiling point HC are purged from the respective canisters using the flow of air inspired into the intake system 13.

A large amount of fuel vapor generating during the stopping of the engine has been adsorbed in each canister until the engine starts up. FIG. 7 is a graph showing the relationship between the total amount of the air being intook from the atmosphere introducing passage 23 and having passed through each canister (abscissa) and the amount of fuel purged from the canister (ordinate) when the canister which has adsorbed a large amount of fuel vapor is purged. Since it is considered that the total amount of the intook air is proportional to a purge time, the amount of the purged fuel exponentially decreases with the purge time. In other words, a large amount of fuel vapor is purged immediately after the purge has started.

Thus, immediately after the purge has started in the prior art, a large amount of fuel vapor is purged at once from both canisters 14 and 15 to be supplied to an engine, and consequently the air-fuel ratio in the engine becomes over-rich to adversely affect the driving characteristics. In addition, there is a problem that a long time is taken before the purge is completed, because the fuel vapor is purged only gradually when time has elapsed since the start of the purge and the fuel vapor adsorbed in the canister has decreased. That is, there is a problem that quick purging cannot be performed since the amount of fuel to be purged tends to be excessively large immediately after the starting of the engine, whereas, thereafter, the amount of fuel to be purged promptly becomes smaller.

SUMMARY OF THE INVENTION

It is an object of the present invention to provide a fuel vapor collecting system which particularly allows quick purging while properly maintaining the air-fuel ratio just after the start of the engine.

The present invention comprises a plurality of canisters for adsorbing the fuel vapor generating from a fuel tank (and a float chamber, in some applications) during a stopping of the engine, means for selecting a canister to be purged from the plurality of canisters, and purge means for purging the selected canister, wherein the selecting means increases the number of canisters to be purged, as the time elapses after the starting of the engine. At the final stage, the all canisters are subjected to purging.

At the initial purging stage in which a large amount of fuel vapor is adsorbed in each canister and a large amount of fuel vapor can be purged from each canister, only the fuel vapor adsorbed in part of the canisters is purged, so that the fuel vapor is gradually purged. In consequence, a rich fuel vapor is not supplied to an internal combustion engine especially at the start of the engine, thereby preventing the air-fuel ratio from being over-rich.

When the fuel vapor adsorbed in the canister being purged has decreased to such an extent that a large amount of fuel vapor cannot be purged, other canisters are subjected to purging by degree, and eventually the fuel vapors adsorbed in the all canisters are purged substantially at the same time. As a result, the fuel to be purged can be ensured in a certain amount or more, and purging can be made in a short time.

DETAILED DESCRIPTION OF THE PREFERRED EMBODIMENT

Figure 1:
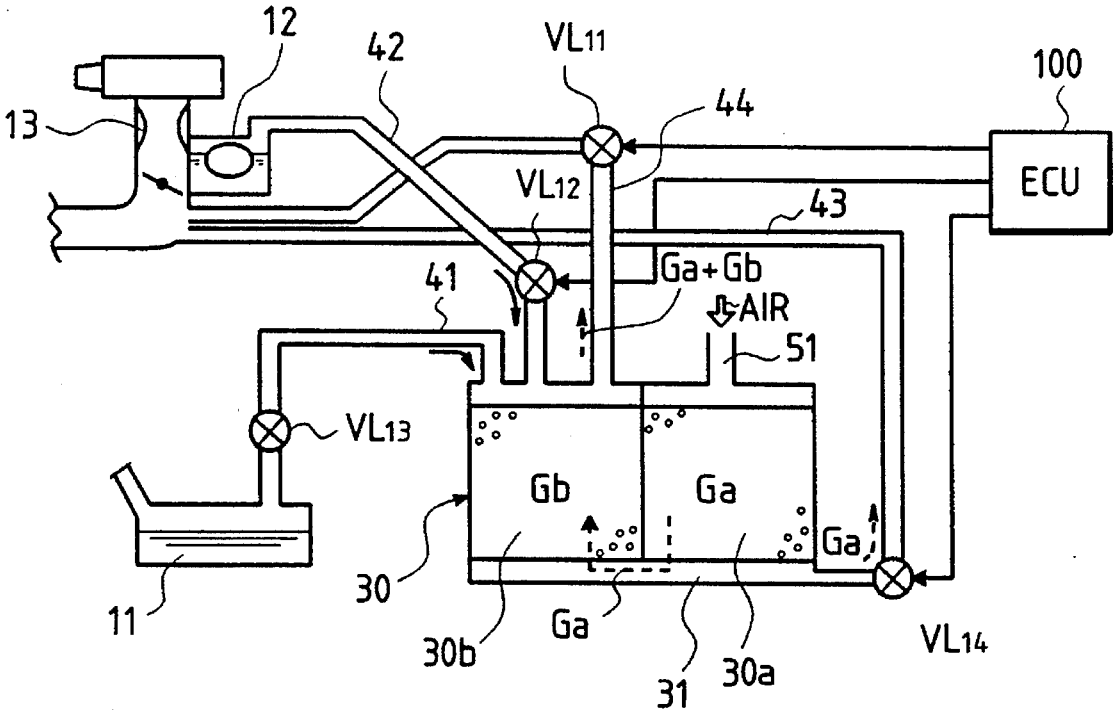
FIG. 1 is a system diagram of the first embodiment of the present invention.

FIG. 1 is a system diagram of the fuel vapor collecting system which is the first embodiment of the present invention.

A canister 30 is partitioned into two canister chambers 30*a* and 30*b* each containing an adsorbent. Into the upper space of the canister chamber 30*b*, a fuel vapor is introduced from the upper space of a fuel tank 11 via a fuel vapor passage 41, and a fuel vapor may also be introduced from a float chamber 12 via a fuel vapor passage 42 during a stopping of the engine. The adsorbed fuel vapor is led to an inspire or intake system 13 via a fuel vapor purging passage 44 after the engine starts.

In the vapor passages 41 and 42 and the purging passage 44, a two-way valve $VL_{13}$ and electromagnetic valves $VL_{12}$ and $VL_{11}$ are provided, respectively. The two-way valve $VL_{13}$ is a mechanical valve consisting of a positive-pressure valve which is opened when the pressure in the fuel tank 11 is higher than the atmospheric pressure by a first preset value, and a negative-pressure valve which is opened when the pressure in the tank 11 is lower than the pressure in the canister by a second preset value. Since the float chamber 12 is omitted in an electronic fuel injection control system, the fuel vapor is led only from the fuel tank 11. Connected to the upper space of the canister chamber 30*a* is an atmosphere introducing passage or a port 51 which is open to the atmosphere and caused to communicate with the atmosphere at the time of purging.

Figure 2:
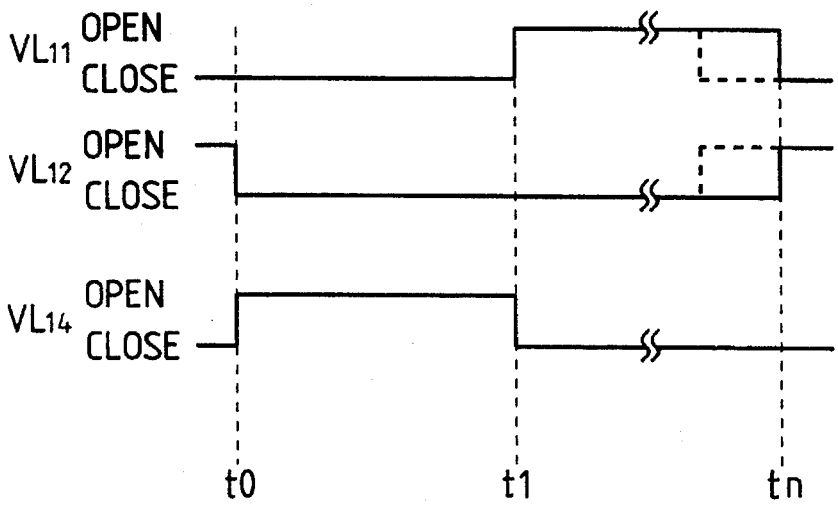
FIG. 2 is a timing chart showing the operation of the embodiment shown in FIG. 1.

The canister chambers 30*a* and 30*b* are connected in series via a communication path 31 in the lower portion of them to form a canister train, and the communication path 31 is made to communicate with the intake system 13 via an electromagnetic valve $VL_{14}$ and a purging passage 43. The electromagnetic valves $VL_{11}$, $VL_{12}$ and $VL_{14}$ are opened and closed by the instructions from an ECU (electronic control unit) 100. As shown in the timing chart of FIG. 2, when the engine is started up and its warm-up is completed at time $t_0$, the ECU 100 closes the electromagnetic valve $VL_{12}$ and opens the electromagnetic valve $VL_{14}$. As a result, the negative pressure by the intake system 13 acts on the canister chambers 30*a* and 30*b* via the purging passage 43. On the other hand, the two-way valve $VL_{13}$ is not opened by the negative pressure on the canister side, and thus the purging air is introduced only from the port 51 open to the atmosphere. In consequence, only the adsorbent in the canister chamber 30*a* is purged, so that its fuel vapor Ga is supplied to the intake system via the purging passage 43.

At time $t_1$ after the elapse of a predetermined time (to be described later) since the time $t_0$, the ECU 100 opens the electromagnetic valve $VL_{11}$ in a closed state and closes the electromagnetic valve $VL_{14}$ in an open state. As a result, the negative pressure is conducted to the canister chamber 30*b* via a purging passage 44, which causes the canister chambers 30*a* and 30*b* to be purged by the air introduced from the port 51 open to the atmosphere, whereby the fuel vapors Ga and Gb in the chambers 30*a*, 30*b* are supplied to the intake system 13 via the purging passage 44 and the valve $VL_{11}$.

The predetermined time ($t_1$–$t_0$) is a time taken for the fuel vapor purged from each canister to decrease to a predetermined amount, and it can be determined experimentally and/or empirically. Instead of based on a predetermined time as described above, the switching of the purging passages may be performed by detecting the amount of fuel purged from the canister chamber 30*a* through the purging passage 43 with an appropriate means and performing the switching when the amount of purged fuel per unit time becomes smaller than a predetermined value, or when the total amount of purged fuel exceeds a predetermined value.

Figure 8:
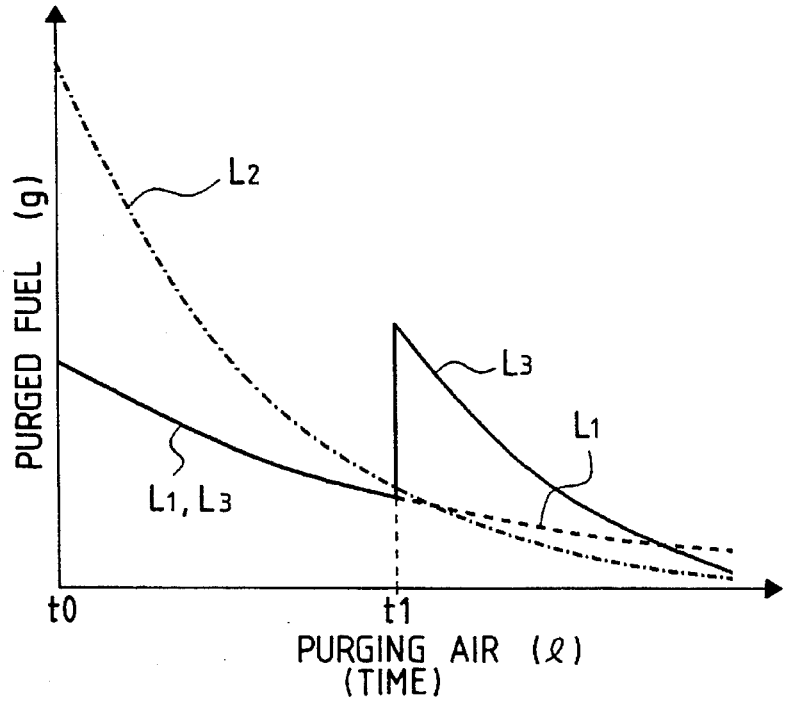
FIG. 8 is a graph showing the change with the passage of in the amount of purged fuel adsorbed in canisters with time according to the present invention.

FIG. 8 is a graph showing the relationship between the total amount of purging air and the amount of purged fuel adsorbed in the adsorbent in this embodiment, where curve $L_1$ represents a theoretical value for the amount of fuel purged only through the purging passage 43. Chain line $L_2$ is a theoretical value for the amount of fuel purged only through the purging passage 44, and solid line $L_3$ represents the amount of purged fuel when the purging through the purging passage 43 is initiated at time $t_0$ and the switching to the purging passage 44 is performed at time $t_1$ according to this embodiment.

In accordance with this embodiment, since only the fuel vapor adsorbed in the canister chamber 30*a* is purged for a while ($t_1$–$t_0$) after the starting of the engine, no rich fuel vapor is supplied to the engine, preventing the air-fuel ratio from becoming over-rich. Further, on and after time $t_1$, the fuel vapors adsorbed in both canister chambers 30*a* and 30*b* are simultaneously purged, thus shortening the time taken for the purge to be completed. The canister chamber 30*a* having the port 51 open to the atmosphere is purged first, and thus, even if the purging is interrupted by a stop of the engine before the purging of both canister chambers 30*a* and 30*b* is completed, the amount of the adsorbed fuel vapor remaining in the canister chamber 30*a* is rather small, and evaporation of the fuel through the port 51 can hence be suppressed to a minimum amount.

Figure 3:
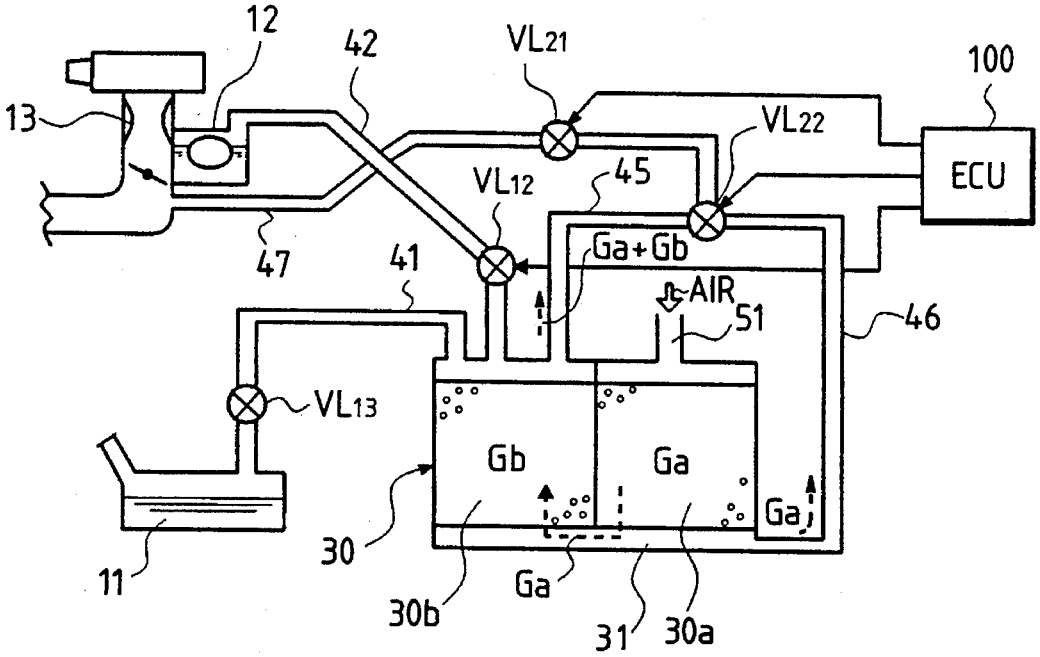
FIG. 3 is a system diagram of the second embodiment of the present invention.

FIG. 3 is a system diagram of the second embodiment of the present invention, in which the same symbols as described above represent the same or identical portions. There are provided a three-way electromagnetic valve $VL_{22}$ for allowing either a purging passage 45 connected to a canister chamber 30*b* or a purging passage 46 connected to a canister chamber 30*a* to communicate with a vapor passage 47, and an electromagnetic valve $VL_{21}$ for opening and closing the passage 47.

In this embodiment, since the purging passage 46 is made to communicate with the passage 47 by the valve $VL_{22}$ immediately after the start of purging, only the fuel vapor Ga adsorbed in the canister chamber 30*a* is purged through the passages 46 and 47 when the valve $VL_{21}$ is opened by the ECU 100. Further, after the elapse of a predetermined time, the purging passage 45 is made to communicate with the passage 47 by the switching of the three-way valve $VL_{22}$ so that the canister chambers 30*a* and 30*b* are connected in series, whereby the adsorbed fuel vapors Ga and Gb in the respective canisters are purged at the same time through the passages 45 and 45. As obvious, an effect similar to the first embodiment is also achieved by this embodiment.

Although single canister is divided into two chambers in the above described first and second embodiments, the present invention is not limited to these, but it can be applied to a fuel vapor collecting system of any construction, provided that such system has a plurality of canisters for adsorbing a fuel vapor during stopping of the engine stops, selectively purges only the fuel vapor adsorbed in a part of the canisters immediately after the start of purging, and purges the fuel vapors adsorbed in the all canisters after the elapse of a predetermined time.

Figure 4:
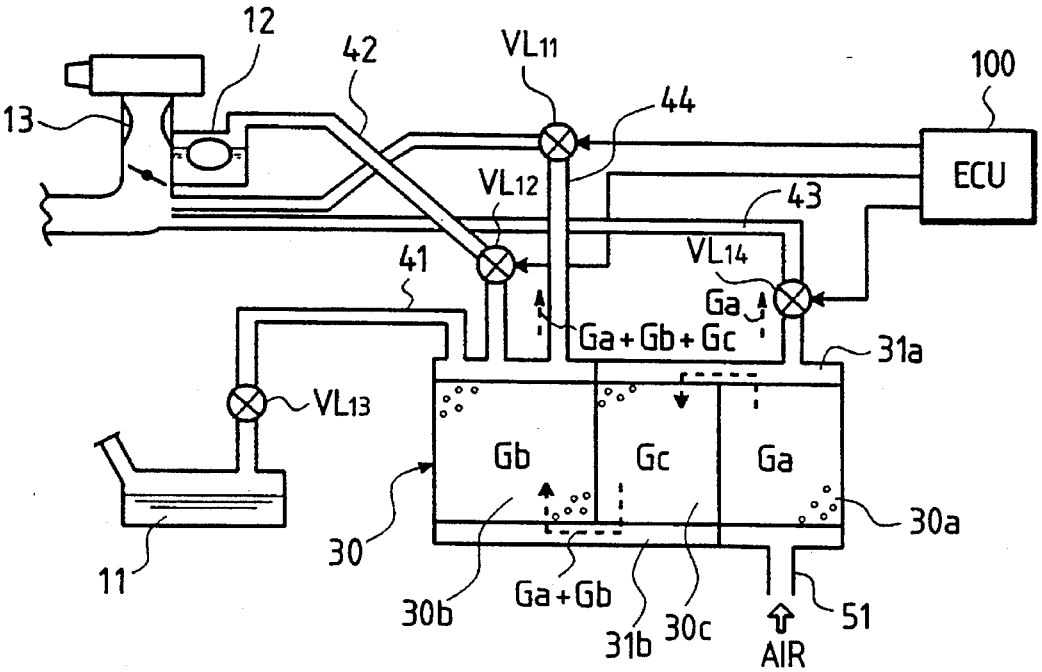
FIG. 4 is a system diagram of the third embodiment of the present invention.

FIG. 4 is a system diagram of the third embodiment of the present invention, in which the same symbols as FIG. 1 represent the same or identical portions. A single canister 30 is divided into three canister chambers 30*a*, 30*b* and 30*c*, and these canister chambers are connected in series each other by connecting the canister chambers 30*a* and 30*c* by a communication passage 31*a* and connecting the canister chambers 30*b* and 30*c* by a communication passage 31*b*, thereby forming a canister train. In other words, this embodiment is obtained by adding the third canister chamber 30*c* between the canister chambers 30*a* and 30*b* in FIG. 1.

Also in this embodiment, a valve $VL_{14}$ opens immediately after the start of purging while other valves are closed, thereby allowing only the fuel vapor Ga adsorbed in the canister chamber 30*a* to be purged through a purging passage 43. Further, since the valve $VL_{14}$ closes and a valve $VL_{11}$ opens after the elapse of a predetermined time, the all canister chambers 30*a*, 30*b* and 30*c* are connected in series, so that the adsorbed fuel vapors Ga, Gb and Gc are purged at the same time through a purging passage 44.

Figure 5:
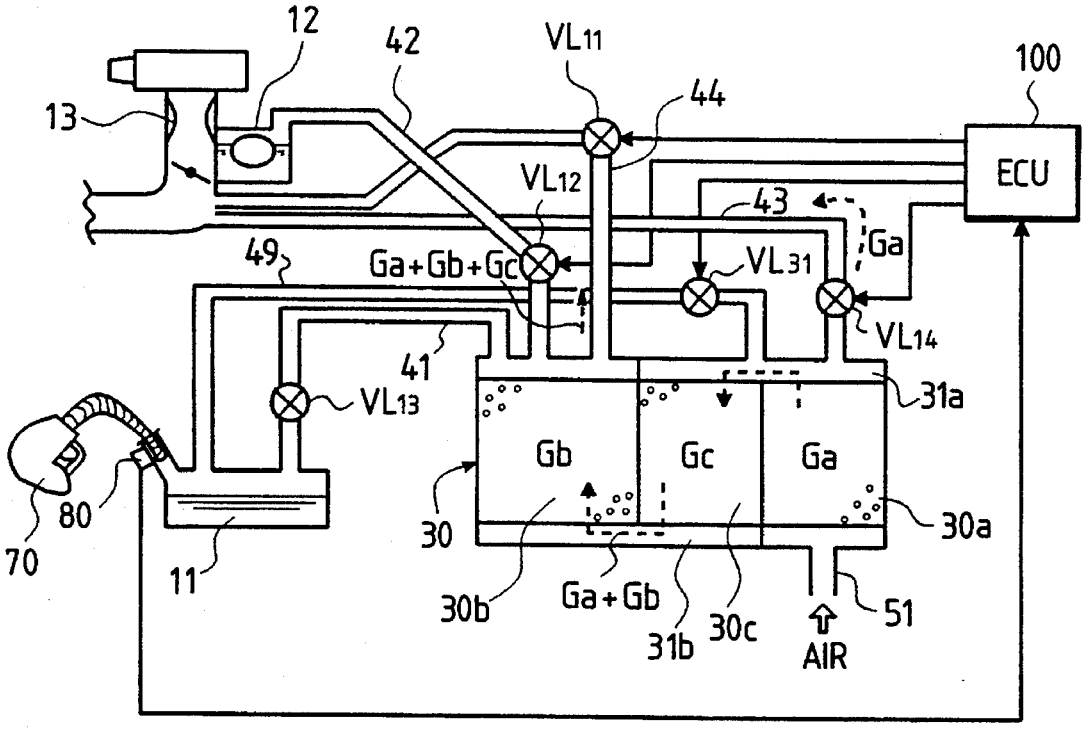
FIG. 5 is a system diagram of the fourth embodiment of the present invention.

FIG. 5 is a system diagram of the fourth embodiment of the present invention, in which the same symbols as FIG. 4 represent the same or identical portions. This embodiment is characterized in that in addition to the third embodiment, a communication passage 31*a* connecting canister chambers 30*a* and 30*c* is connected to the upper space of a fuel tank 11 by a vapor passage 49 with an electromagnetic valve $VL_{31}$, and a sensor 80 is provided for sensing the insertion of a fuel feeding gun 50 into the fuel tank 11 for refuelling. And opening the valve $VL_{31}$ in response to the detection of the insertion of the fuel feeding gun 70 causes the fuel vapor in the fuel tank 11 to be supplied to the canisters 30*a* and 30*c*. Instead, the vapor passage 49 may be connected to a communication passage 31*b* to allow the fuel vapor in the fuel tank 11 to be supplied to the canisters 30*b* and 30*c*, but the distance to a port 51 open to the atmosphere is longer and the ventilation resistance is larger as compared with the case that vapor passage 49 is connected to the communication passage 31*a*, and it is thus desirable that the vapor passage 49 is connected to the communication passage 31*a* which is nearer to the port 51, as shown. In addition, the vapor passage 49 may be connected to both communication passages 31*a* and 31*b*.

In accordance with this embodiment, the fuel vapor generating in the fuel tank 11 during refuelling can be supplied to the canisters to suppress the pressure increase in the fuel tank 11, so that the refuelling can be quickly done. In this case, since the internal pressure of the tank 11 does not increase to the value at which the positive pressure valve operates, a valve $VL_{13}$ is kept to be closed.

Figure 9:
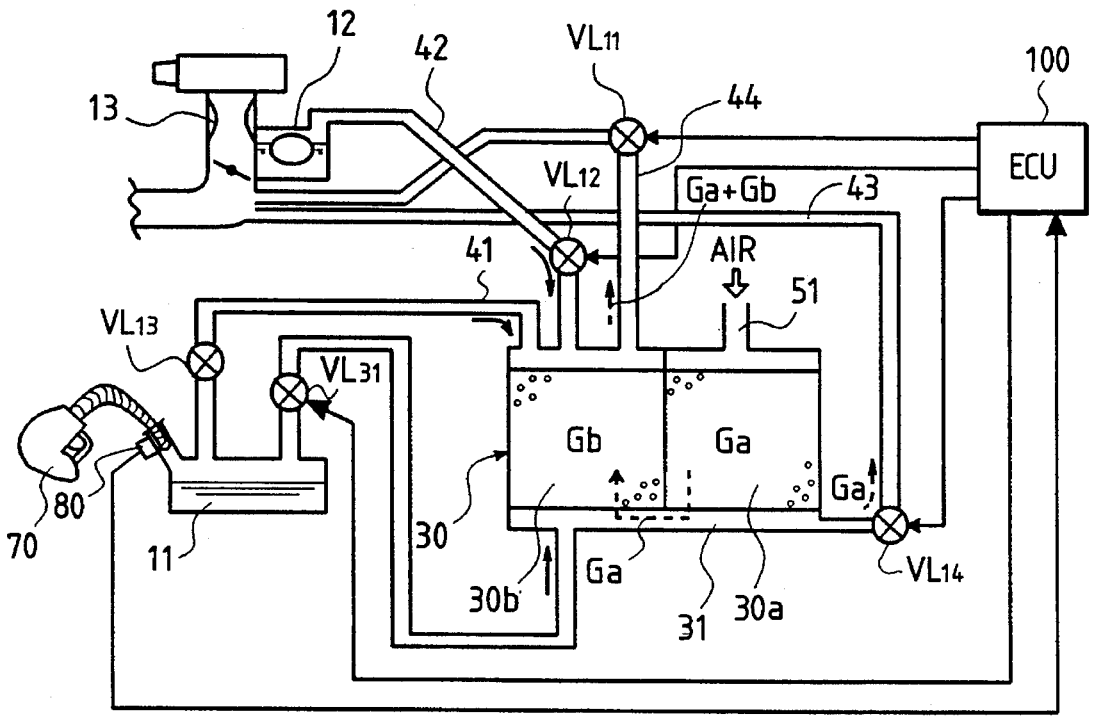
FIG. 9 is a system diagram of the fifth embodiment of the present invention.

The characteristic construction of FIG. 5 is also applicable to the above described first and second embodiments. An example of the application to the first embodiment is shown in FIG. 9.

Figure 6:
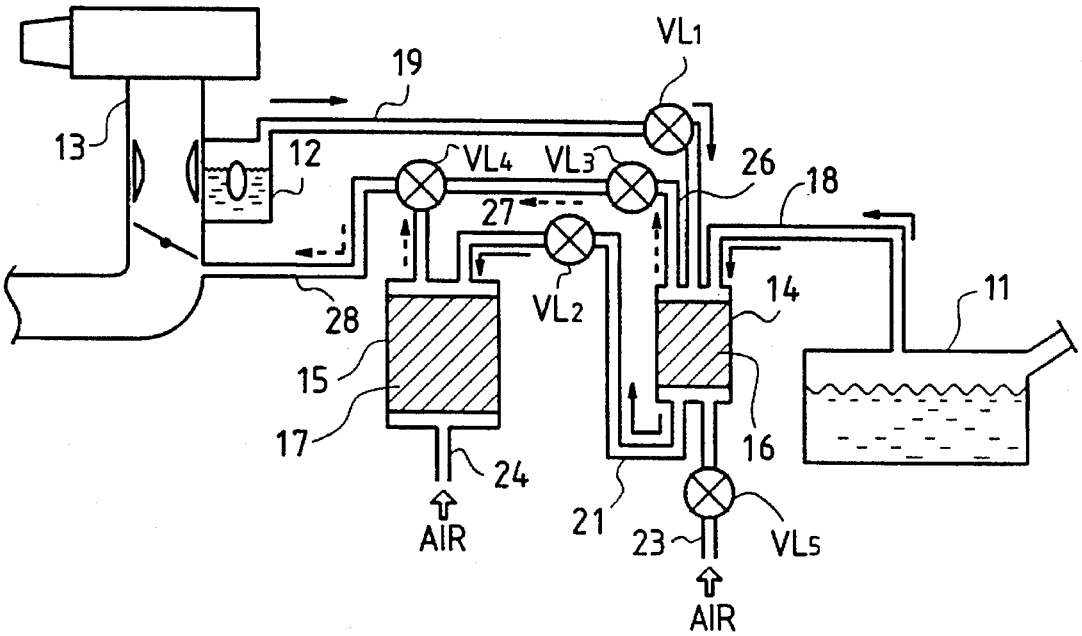
FIG. 6 PRIOR ART
FIG. 6 is a system diagram of the conventional fuel vapor collecting system.
Figure 7:
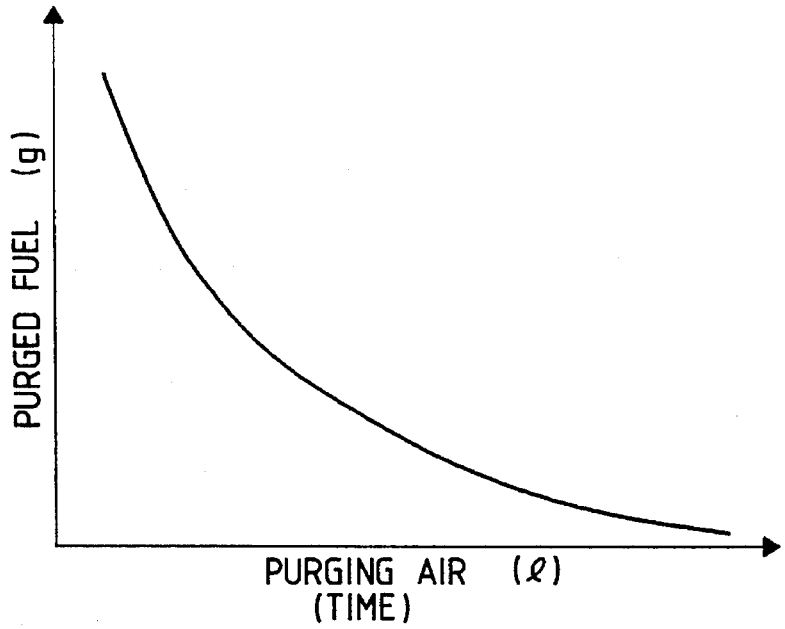
FIG. 7 is a graph showing the relationship between the total amount of purged air and the amount of purged adsorbed fuel.

Although, in the above described respective embodiments, the description has been made on the assumption that the inside space of a single canister is divided by partitions into a plurality of canister chambers each of which is used as an independent canister, each canister chamber may be constructed by a separate canister, as in the prior art described with reference to FIG. 6. Also, a plurality of canister chambers may be grouped into three or more to allow switching so that each group is connected in series one by one.

The following advantages are achieved in accordance with the present invention.

(1) Since only the fuel vapor adsorbed in a part of the canisters is purged for a while after the starting of the engine, a rich fuel vapor is not supplied to the engine, thereby preventing the air-fuel ratio from becoming over-rich. Thereafter, the fuel vapor adsorbed in the all canisters are purged at the same time, thus enabling the reduction in the time taken to complete the purging. As a result, the amount of fuel purged per unit time is averaged to suppress the variation of the air-fuel ratio in the engine, whereby deterioration of the driving characteristics can be prevented during the purging.

(2) Since the canister chamber having a port open to the atmosphere is purged first, evaporation of the fuel from the port can be suppressed to a minimum even if the purging is interrupted by stopping of the engine before the canisters are completely purged.

(3) By providing a construction in which the upper space of the fuel tank communicates with a canister when a fuel feeding gun is inserted into the fuel tank for refuelling, the pressure increase in the fuel tank during refuelling can be prevented, allowing the refuelling to be quickly done.

What is claimed is:

1. A fuel vapor collecting system in which a fuel vapor adsorbed during a stopping of the engine is purged after a starting of the engine, comprising:

a plurality of canisters connected in series with communication passages to form a canister train and each adsorbing the fuel vapor generating at least in a fuel tank, a port open to an atmosphere which is formed in one end of said canister train, a first purging passage for connecting at least one of the communication passages to an intake system of the engine, a port for introducing the fuel vapor which is formed in the other end of said canister train, a second purging passage for connecting said other end to the intake system of the engine, a first purging means for selectively purging only the fuel vapor adsorbed in at least one canister between the communication passage to which said first purging passage is connected and the port open to the atmosphere, with the air inspired in through the port open to the atmosphere by the negative pressure generated in said first purging passage, a second purging means for purging the fuel vapor adsorbed in all canisters connected in series, with the air inspired in through the port open to the atmosphere by the negative pressure generated in said second purging passage, and a purging switching means for switching the purge by the first purging means to the purge by the second purging means after the elapse of a predetermined time since the start of the purging by the first purging means.

2. A fuel vapor collecting system claimed in claim 1 wherein said purge switching means open one of the valve means respectively provided in said first and second purging passages and close the other.

3. A fuel vapor collecting system claimed in claim 1 wherein said first and second purging passages are connected to the intake system through a common three-way valve.

4. A fuel vapor collecting system claimed in claim 1 wherein said port for introducing the fuel vapor is connected to the upper space of the fuel tank through a two-way valve.

5. A fuel vapor collecting system claimed in claim 1 further comprising:

a piping means with a valve for allowing at least one communication passage to communicate with the upper space of the fuel tank, a means for detecting a refuelling into the fuel tank, and a means responsive to said detection of the refuelling for opening the valve of said piping means, thereby to allow the fuel vapor in the fuel tank to be adsorbed by the canisters connected to said at least one communication passage.

6. A fuel vapor collecting system in which a fuel vapor adsorbed during a stopping of the engine is purged after a starting of the engine, comprising:

a first and a second canisters each adsorbing the fuel vapor generating at least in a fuel tank, a communication passage for connecting the first and the second canisters each other in series at their one ends, a port open to an atmosphere which is formed in the other end of the first canister, a first purging passage for connecting the communication passage to an intake system of the engine, a port formed in the other end of the second canister for introducing the fuel vapor into the canisters, a second purging passage formed in the other end of the second canister for connecting said other end of the second canister to the intake system of the engine, a first purging means for purging only the fuel vapor adsorbed in the first canister, while closing the second purging passage and the port for introducing the fuel vapor, with the air inspired in through the port open to the atmosphere by the negative pressure generated in said first purging passages, a second purging means for purging the fuel vapor adsorbed in the first and second canisters, while closing the first purging passage and the port for introducing the fuel vapor, with the air inspired in through the port open to the atmosphere by the negative pressure generated in said second purging passage, and a purge switching means for switching the purge by the first purging means to the purge by the second purging means after the elapse of a predetermined time since the start of the purging by the first purging means.

7. A fuel vapor collecting system claimed in claim 6 wherein said purge switching means open one of the valve means respectively provided in said first and second purging passages and close the other.

8. A fuel vapor collecting system claimed in claim 6 wherein the port for introducing the fuel vapor is also communicated to a space in an upper portion of a float chamber through a valve.

9. A fuel vapor collecting system claimed in claim 6 wherein said port for introducing the fuel vapor is connected to the upper space of the fuel tank through a two-way valve.

10. A fuel vapor collecting system for an internal combustion engine in which a fuel vapor adsorbed during a stopping of the engine is purged after a starting of the engine, comprising:

a plurality of canisters in communication with at least a fuel tank for adsorbing the fuel vapor generating in at least fuel tank, selecting means for selecting at least one of said plurality of canisters as an object for purging, and a purging means for purging the fuel vapor adsorbed in said at least one canister selected, wherein said selecting means increases the number of canisters as an additional object for purging as the time elapses after the starting of the engine.

11. A fuel vapor collecting system claimed in claim 10 wherein said selecting means connect the canister or canisters added as the object for purging to the previously selected canister or canisters in series with a communication passage, and eventually select the all canisters, a purge switching means for switching the purge by the first purging means to the purge by the second purging means after the elapse of a predetermined time since the start of the purging by the first purging means.

* * * * *